US007074745B2

(12) United States Patent
Shaub et al.

(10) Patent No.: US 7,074,745 B2
(45) Date of Patent: Jul. 11, 2006

(54) ENGINE OIL ADDITIVE

(75) Inventors: Harold Shaub, Irving, TX (US); Pranesh B. Aswath, Grapevine, TX (US); Md. Zahedul Huq, Farmington Hills, MI (US)

(73) Assignee: Platinum Intellectual Property, L.P., Dallas, TX (US)

( * ) Notice: Subject to any disclaimer, the term of this patent is extended or adjusted under 35 U.S.C. 154(b) by 0 days.

(21) Appl. No.: 10/965,686

(22) Filed: Oct. 14, 2004

(65) Prior Publication Data

US 2005/0119135 A1 Jun. 2, 2005

Related U.S. Application Data

(60) Provisional application No. 60/511,290, filed on Oct. 15, 2003.

(51) Int. Cl.
*C10M 125/18* (2006.01)
*C10M 137/06* (2006.01)

(52) U.S. Cl. ..... 508/165; 508/171; 508/369; 508/371

(58) Field of Classification Search ..... 508/165, 508/171, 371

See application file for complete search history.

(56) References Cited

U.S. PATENT DOCUMENTS

| | | | | |
|---|---|---|---|---|
| 4,130,492 | A * | 12/1978 | Longo et al. | 508/161 |
| 4,832,859 | A | 5/1989 | Basset et al. | |
| 5,133,886 | A * | 7/1992 | Hata | 508/165 |
| 5,595,962 | A | 1/1997 | Caporiccio et al. | |
| 5,641,731 | A | 6/1997 | Baumgart et al. | |
| 5,877,128 | A * | 3/1999 | Greer | 508/113 |
| 6,413,918 | B1 | 7/2002 | Beatty et al. | |
| 6,541,430 | B1 | 4/2003 | Beatty | |
| 6,642,186 | B1 | 11/2003 | Beatty et al. | |
| 6,734,320 | B1 | 5/2004 | Beatty et al. | |
| 6,764,984 | B1 | 7/2004 | Beatty | |

OTHER PUBLICATIONS

International Search Report and Written Opinion issued for PCT/US04/34272 dated Sep. 1, 2005.

* cited by examiner

*Primary Examiner*—Ellen M. McAvoy
(74) *Attorney, Agent, or Firm*—Fulbright & Jaworski LLP

(57) ABSTRACT

A process and method for manufacturing an improved engine oil comprising mixing ferric fluoride with ZDDP to form an additive mixture, heating the additive mixture to at least 125° C. for at least 4 hours to produce a pre-reacted mixture, and adding the pre-reacted mixture to a fully formulated engine oil not containing ZDDP. Also disclosed is an engine oil prepared by a process comprising mixing catalyst with ZDDP to form an additive mixture, heating the additive mixture to about 60° C. to produce a pre-reacted additive mixture, and adding the pre-heated additive mixture to a fully formulated engine oil not containing ZDDP.

20 Claims, 4 Drawing Sheets

*FIG. 1*

| SR. NUMBER | TYPE OF FULLY FORMULATED OIL | DETAILS | PROFILOMETRIC RESULTS (WEAR TRACK DEPTH) (MICRONS) |
|---|---|---|---|
| 1 | GF4 (WITH ADDITIVE PACKAGE) | AS IT IS | 3-4 |
| 2 | GF4 (WITH ADDITIVE PACKAGE) (BAKED) | OIL BAKED AT 125°C FOR 7 DAYS AND FURNACE COOLED | 1.2-2 |
| 3 | GF4 (WITH ADDITIVE PACKAGE) + ZDDP | 0.01%P ADDED | 2-2.5 |
| 4 | GF4 (WITH ADDITIVE PACKAGE) + CATALYST | 0.4%pwd, MASTICATED CATALYST ADDED | 1-1.2 |
| 5 | GF4 (WITH ADDITIVE PACKAGE) + ZDDP + CATALYST | CATALYST (0.4%pwd, MASTICATED) + ZDDP (0.01%P) - PREMIXED AND ADDED TO OIL | 1.2-2 |
| 6 | GF4 (WITH ADDITIVE PACKAGE) + [ZDDP + CATALYST - MIXTURE PREACTIVATED] | CATALYST (0.4%pwd, MASTICATED) + ZDDP (0.01%P) - PREMIXED AND BAKED AT 125°C FOR 4hrs AND THEN ADDED TO OIL | ≤1 |

*FIG. 3*

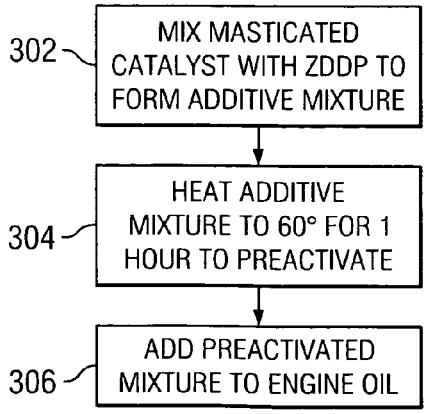

SAMPLE 1: 500 ppm P, 80 ppm MO AND 0% PRO CATALYST
SAMPLE 2: 500 ppm P, 80 ppm MO AND 0.4% PRO CATALYST
SAMPLE 3: 100 ppm P, 80 ppm MO AND 0% PRO CATALYST
SAMPLE 4: 100 ppm P, 0 ppm MO AND 0% PRO CATALYST
SAMPLE 5: 100 ppm P, 80 ppm MO AND 0.4% PRO CATALYST
SAMPLE 6: 100 ppm P, 0 ppm MO AND 0.4% PRO CATALYST
BASELINE: 750 ppm P, 80 ppm MO AND 0% PRO CATALYST

ENGINE OIL ADDITIVE

CROSS-REFERENCE TO RELATED APPLICATIONS

This application claims priority to U.S. patent application Ser. No. 60/511,290 filed on Oct. 15, 2003.

TECHNICAL FIELD

The present application relates generally to engine oil additives and, more particularly, to the reduction of zinc dialkyldithiophosphate (ZDDP) and phosphorous in engine oil.

BACKGROUND OF THE INVENTION

More than four billion quarts of crankcase oil are used in the United States per year. Currently available engine oils include the anti-wear additive zinc dialkyldithiophosphate (ZDDP), which contains phosphorous and sulfur. These are elements that poison catalytic converters causing increased automotive emissions. It is expected that the EPA eventually will mandate the total elimination of ZDDP or will allow only extremely low levels of ZDDP in engine oil. However, no acceptable anti-wear additives are currently available to replace ZDDP.

It is an object of the present invention to provide an environmentally friendly anti-wear additive for engine oil, wherein the amounts of phosphorous and sulfur in the anti-wear additive approach zero.

BRIEF SUMMARY OF THE INVENTION

The present invention is directed to a system and method for producing an engine oil additive for improving engine oil properties. An embodiment of the present invention is a method for improving engine oil comprising mixing a catalyst with zinc dialkyldithiophosphate (ZDDP) to form an additive mixture, heating the additive mixture to produce a pre-reacted additive mixture, and adding the pre-reacted additive mixture to engine oil that does not already include ZDDP.

Certain embodiments of the present invention heat a mixture of powdered, masticated catalyst with ZDDP. The catalyst used is ferric fluoride in a preferred embodiment of the invention. The catalyst and ZDDP are heated together to between a range of about 60° C. to about 125° C., preferably to about 60° C., for a time of between one hour and twenty-four hours, preferably about one hour. The heated mixture is then added to engine oil. The engine oils used with the present invention are preferably fully formulated GF4 engine oils without ZDDP.

Other embodiments of the invention comprise an engine oil prepared by a process comprising mixing catalyst with zinc dialkyldithiophosphate (ZDDP) to form an additive mixture, heating the additive mixture to about 60° C. to produce a pre-reacted additive mixture, and adding the pre-reacted additive mixture to a fully formulated engine oil that does not already include ZDDP.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 1 shows a profilometric wear track depth result of a matrix of experiments on GF4 oils produced according to embodiments of the invention;

FIG. 3 shows a flow diagram of a method according to an embodiment of the invention;

DETAILED DESCRIPTION OF THE INVENTION

The present invention provides an improved engine oil wherein additives are mixed with a fully formulated engine oil without ZDDP. The term "fully formulated oils" as used here to illustrate certain embodiments of the present invention are motor oils that include additives, but not zinc dialkyldithiophosphate (ZDDP). In certain embodiments, the fully formulated oil may be, for example, a GF4 oil with an additive package comprising standard additives, such as dispersants, detergents, and anti-oxidants, but without ZDDP. The present invention comprises adding other additives in the form of a pre-reacted catalyst and ZDDP to the oil. The catalyst in a preferred embodiment is ferric fluoride ($FeF_3$). Other catalysts are used in certain embodiments, such as, for example, aluminum trifluoride, zirconium tetrafluoride, titanium trifluoride, and titanium tetrafluoride. In other embodiments, other transition metal fluorides are used, such as, for example, chromium difluoride and trifluoride, manganese difluoride and trifluoride, nickel difluoride, stannous difluoride and tetrafluoride, and combinations thereof.

According to embodiments of the present invention, the catalyst and ZDDP are pre-reacted by premixing and baking prior to combining the catalyst and ZDDP mixture with the fully formulated oil. In a preferred embodiment, the catalyst used is masticated and contains 0.4 percent catalyst powder by weight (0.4 wt %, pwd, masticated), and is mixed with ZDDP with 0.01 weight percent phosphorous content (0.01 wt %P). In other embodiments, the catalyst used is from about 0.2 wt % to about 1.0 wt % powdered, masticated catalyst, and is mixed with ZDDP with from about 0.01 wt % to about 0.05 wt % phosphorous content. The mixture is then baked at 125° C. for four hours before being added to the oil. In certain embodiments of the invention, the mixture is heated to between a range of about 60° C. to about 125° C. In a preferred embodiment, the mixture is heated to about 60° C. The time at which the mixture is baked is from about one hour to about 24 hours in certain embodiments. In a preferred embodiment the mixture is baked for about one hour.

Figure 4:
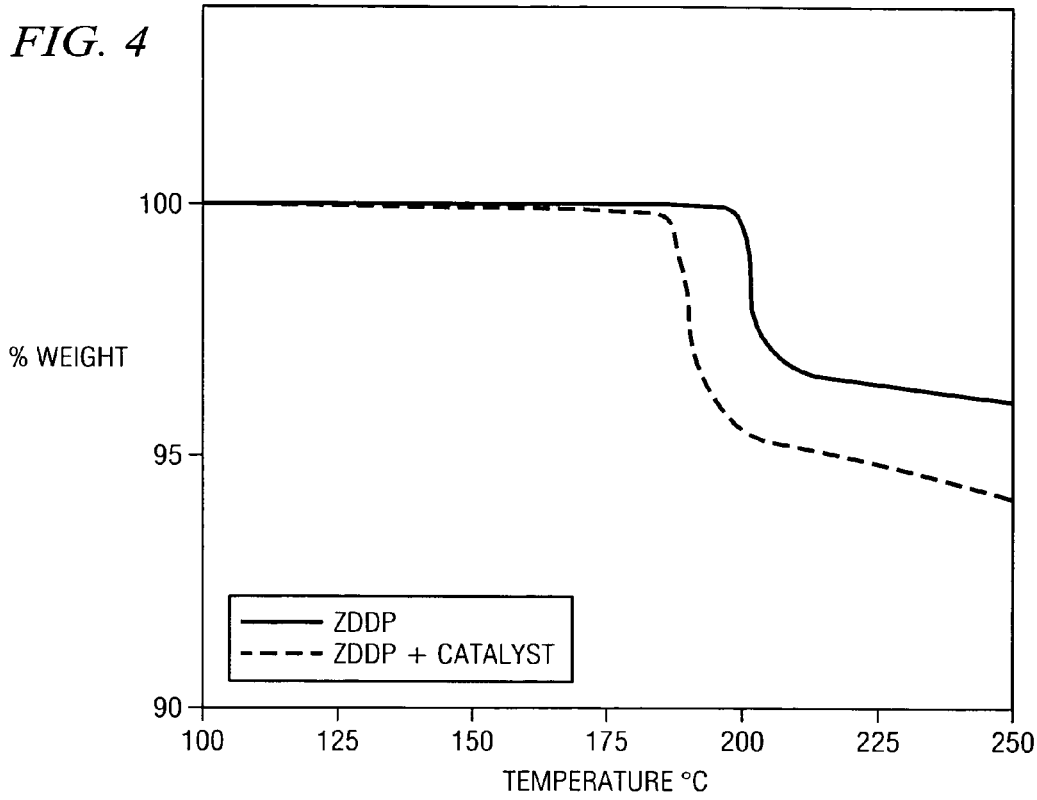
FIG. 4 shows a differential scanning thermogram of ZDDP by itself and ZDDP with catalyst recovered at a heating rate of 5° C./minute in a nitrogen atmosphere.
Figure 5:
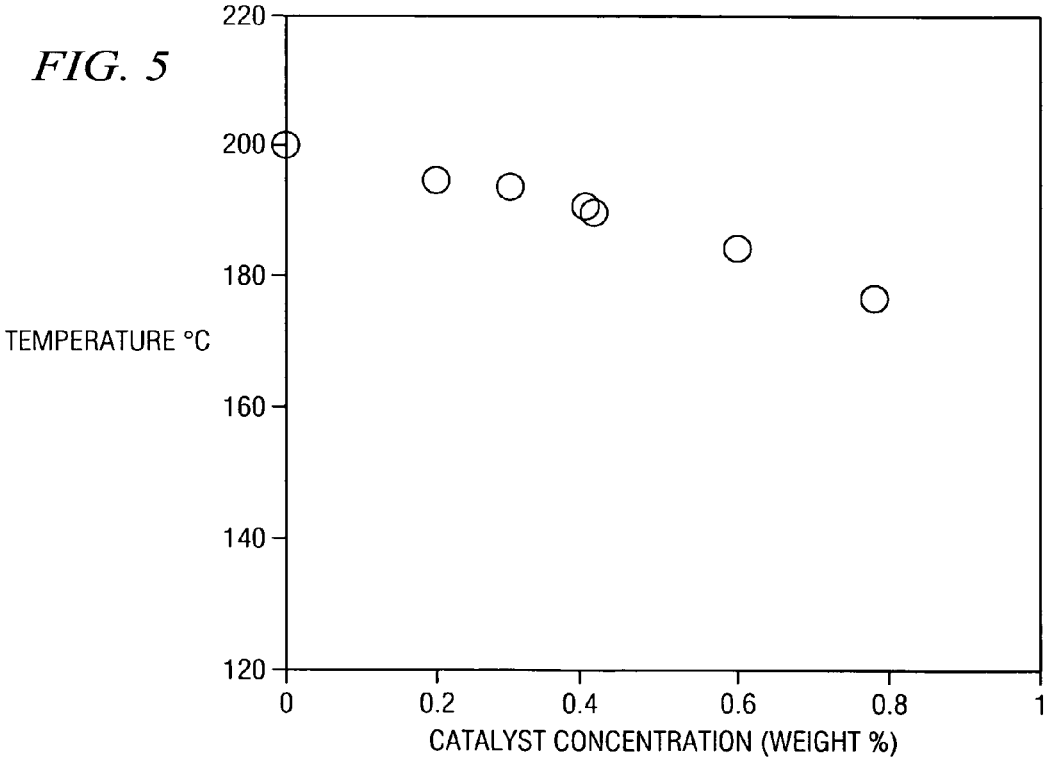
FIG. 5 shows the decomposition temperature of ZDDP in a nitrogen atmosphere as measured using a differential scanning thermogram as a function of the concentration of catalyst produced according to an embodiment of the invention.
Figure 6:
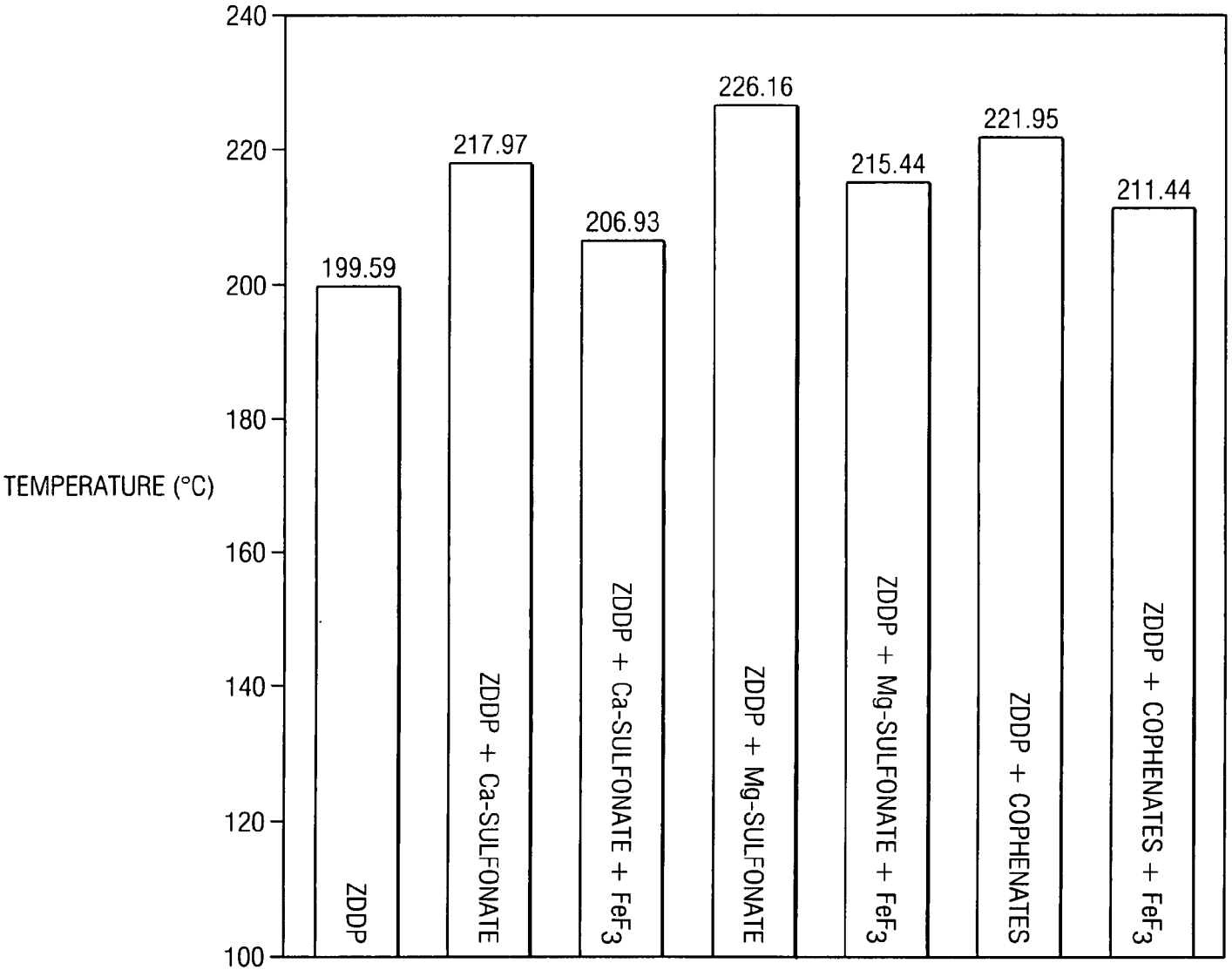
FIG. 6 shows the influence of engine oil detergents Ca-sulfonate, Mg-sulfonate, and cophenates and a catalyst on the decomposition temperature of ZDDP.

This baking pretreatment causes a reaction between the catalyst and ZDDP and allows less ZDDP to be used in the final product. It is believed that in an operating environment, the decomposition of ZDDP produces products the anti-wear characteristics. Accordingly, it is desirable in an operating environment to the ZDDP decompose at as low a temperature as possible. The lower the decomposition temperature, the more effective the ZDDP is as an anti-wear compound. FIGS. 4–6 illustrate experiments showing the effects of embodiments of the invention on the decomposition temperature of ZDDP. Of note is that when ZDDP without pretreatment is mixed with the engine oil, ZDDP reacts with engine detergents (such as calcium sulfonates, magnesium sulfonates, and cophenates) and dispersants and other basic components in the fully formulated oil, including such anti-oxidants as, for example, alkylated diphenyl amines, and causes an increase in decomposition temperature (results shown in FIG. 6). As a result, more ZDDP is required. When ZDDP is pre-reacted with the catalyst, a smaller amount of ZDDP is required in engine oil. The decomposition temperature of pre-reacted ZDDP generally decreases as more catalyst is used, as shown in FIG. 5. FIG. 4 compares the decomposition temperature of pre-reacted ZDDP with that of ZDDP added to fully formulated engine oil, and shows that pre-reacted ZDDP has a lower decomposition temperature. The term "pre-reacted" refers in this embodiment to a chemical reaction comprising bond formulation or bond release between elements or compounds. In certain embodiments of the present invention, "pre-reacted" refers to a chemical reaction, chemical complex formation, acid-based reaction, or salt formation, or other interaction products.

As illustrated in the experimental results, a GF4 fully formulated oil containing no ZDDP that is mixed with pre-reacted catalyst/ZDDP mixture provides significantly improved wear protection. Experiments were performed to evaluate oil formulations produced according to embodiments of the invention. The experiments were conducted on a modified Plint Ball on Cylinder machine TE 53 Slim. The machine was modified to accept standard Timken Roller Bearings, when the outer surface of the cup was used for wear testing. In order to generate consistent results a protocol was established to prepare the surface prior to wear testing. United States Provisional patent application No. 60/511,290 filed on Oct. 15, 2003, and incorporated by reference herein, provides additional details regarding the Plint Machine testing procedure used to evaluate oil formulations in certain embodiments of the invention. Generally, wear track depth and wear volume comparisons were used to compare the oil formulations produced according to embodiments of the invention.

FIG. 1 illustrates a profilometric wear track depth result comparison of the matrix of experiments on a oil produced according to embodiments of the invention. For example, source oil no. 6 in FIG. 1 was produced according to an embodiment of the invention, whereby catalyst (0.4 wt %/pwd, masticated) and ZDDP with 0.01wt % phosphorous content were premixed and baked at 125° C. for four hours and then added to GF4 oil without ZDDP. The GF4 oils in FIG. 1 to which premixed catalyst and ZDDP were added are GF4 oils with an additive package containing no ZDDP. The profilometric results show that the oil made according to an embodiment of the invention is superior in minimizing the wear depth of a bearing used in the modified Plint Ball on Cylinder test described above.

Figure 2:
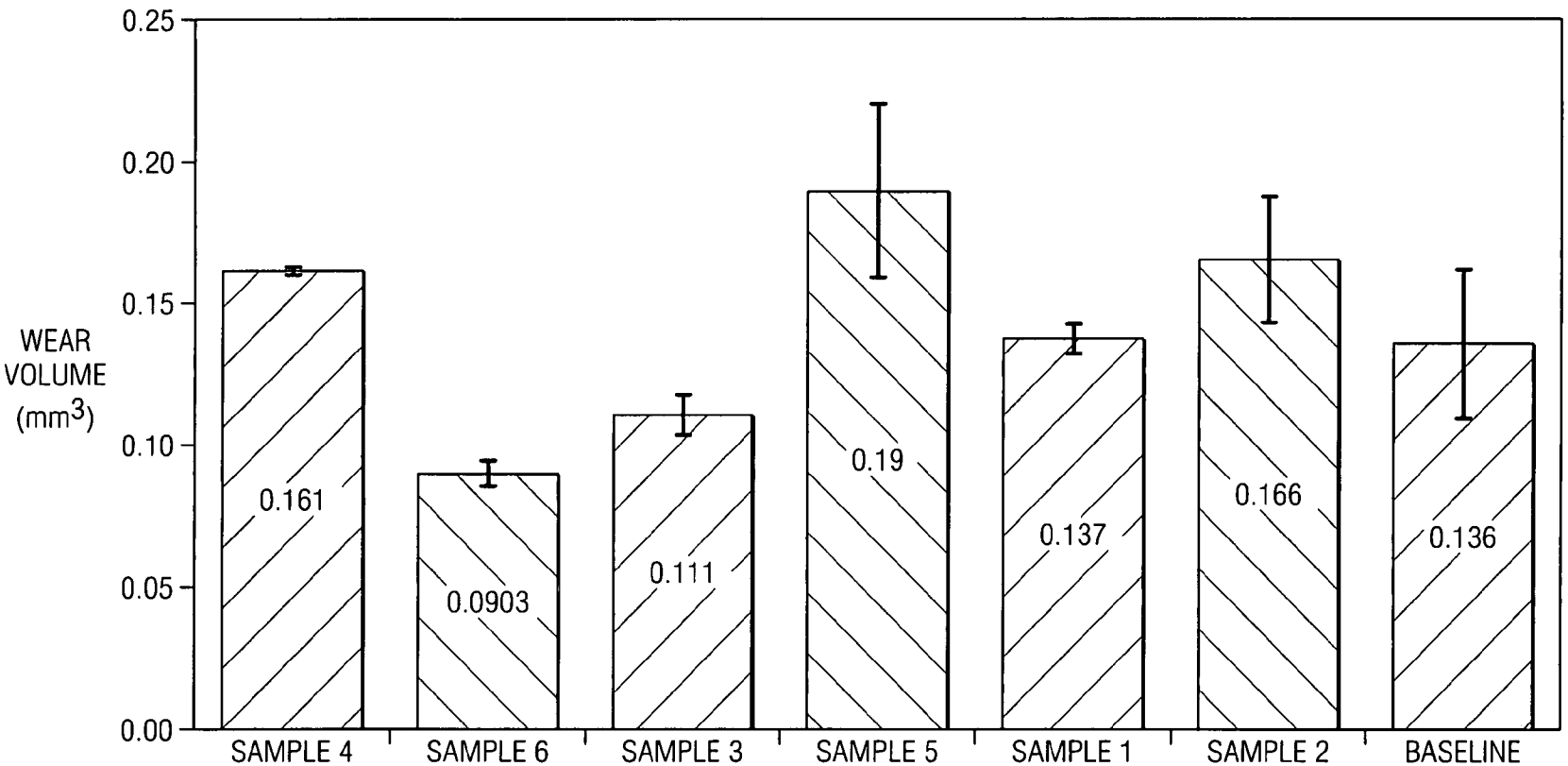
FIG. 2 shows a profilometric wear volume comparison graph for motor oils comprising a pre-reacted additive mixture produced according to an embodiment of the invention.

FIG. 2 shows a wear volume comparison graph for motor oils to which a pre-reacted additive mixture produced according to an embodiment of the invention was added. Each oil formulation varies in the amount of phosphorous (P), molybdenum (Mo), and catalyst (weight percent Pro Catalyst). The catalyst used in certain embodiments is ferric fluoride. However, other catalysts are used in other embodiments, such as, for example, aluminum trifluoride, zirconium tetrafluoride, titanium trifluoride, and titanium tetrafluoride. In other embodiments, other transition metal fluorides are used, such as, for example, chromium difluoride and trifluoride, manganese difluoride and trifluoride, nickel difluoride, and stannous difluoride and tetrafluoride. The amount of molybdenum used in the motor oil varied in the amount for the test motor oils. The molybdenum is used as a supplemental anti-wear additive in low phosphorous engine oils.

FIG. 3 shows a flow diagram of a method according to an embodiment of the invention. In this embodiment, a commercial engine oil containing an additive package without ZDDP and with either 0 ppm or 80 ppm of a molybdenum-containing additive is used as engine oil. A masticated ferric fluoride catalyst is prepared from powder by combining ferric fluoride catalyst with a suspending agent and a base oil. In certain embodiments of the invention, the masticated catalyst and ZDDP with 0.01 wt % phosphorous content are mixed together in step 302 and heated at 60° C. for one hour to produce a pre-reacted mixture in step 304. In other embodiments, different heating times and/or temperatures are used. The pre-reacted mixture is then added to engine oil that does not include ZDDP in step 306. The resultant improved engine oil is then used in an appropriate application such as, for example, an engine crankcase. Improved engine oil produced according to an embodiment of the present invention are used in engines found in, for example, automobiles, trucks, motorcycles, generators, lawn equipment, et cetera.

FIG. 4 shows differential scanning thermograms of ZDDP by itself and ZDDP with catalyst recorded at a heating rate of 5° C./minute in a nitrogen atmosphere. Note that embodiments of the invention do not necessarily require the use of a nitrogen atmosphere. Preferred embodiments of the invention heat additive mixtures in an ambient air atmosphere. The catalyst used in this embodiment is ferric fluoride. However, other catalysts are used in other embodiments, such as, for example, aluminum trifluoride, zirconium tetrafluoride, titanium trifluoride, titanium tetrafluoride and other transition metal fluorides. The plot shows that in the presence of catalyst the decomposition temperature of ZDDP is reduced making it more effective as an anti-wear agent.

FIG. 5 shows the decomposition temperature of ZDDP in a nitrogen atmosphere as a function of the concentration of a catalyst, as measured using a differential scanning thermogram. The catalyst used in this embodiment is ferric fluoride. However, other catalysts are used in other embodiments, such as, for example, aluminum trifluoride, zirconium tetrafluoride, titanium trifluoride, titanium tetrafluoride and other transition metal fluorides. The plot shows that the decomposition temperature of ZDDP is a strong function of catalyst concentration with clear evidence that decomposition temperature is reduced as the catalyst concentration is increased. The anti-wear agents that are responsible for wear protection are decomposition products of ZDDP and the catalyst helps to reduce the decomposition temperature of ZDDP and thus increasing ZDDP's anti-wear properties.

FIG. 6 shows the decomposition temperature of ZDDP, DDP+Ca-sulfonates, ZDDP+Ca-sulfonate+$FeF_3$, ZDDP+Mg-sulfonate, ZDDP+Mg-sulfonate +$FeFe_3$, ZDDP+cophenate, and ZDDP+cophenate+$FeF_3$ recorded at a heating rate of 5° C./min under nitrogen. This figure shows the influence of detergents (Ca-sulfonate, Mg-sulfonate and cophenates, which are ingredients in engine oils) on the decomposition temperature of ZDDP. In general, the decomposition temperature of ZDDP goes up in presence of all three studied detergents. Ca-sulfonate, Mg-sulfonate, and cophenates raise the decomposition temperatures of ZDDP by about 18, 26, and 22° C., respectively. Crankcase oil detergents, such as calcium sulfonates and phenates, are powerfully antagonistic to the wear-reducing properties of ZDDP. As high-polar additives, the detergents may actively compete with the ZDDP for the rubbing surfaces. Overbased sulfonates can also retard the rate of ZDDP decomposition. In the presence of $FeF_3$, ZDDP decomposes at a lower temperature, even in the presence of detergents. The differential scanning thermograms of the ZDDP with detergents and catalyst indicate that $FeF_3$ helps to reduce the ZDDP decomposition temperature on average by 11° C., even in the presence of detergents. The presence of the catalyst compensates for the antagonistic effect of the detergents in oils and enhances the anti-wear performance of ZDDP.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method for improving engine oil comprising:

mixing a catalyst with zinc dialkyldithiophosphate (ZDDP) to form an additive mixture, wherein said catalyst is a metal fluoride;

heating the additive mixture to produce a pre-reacted additive mixture; and adding the pre-reacted additive mixture to engine oil that does not already include ZDDP.

2. The method of claim 1 wherein said metal fluoride is selected from the group consisting of:

aluminum trifluoride, zirconium tetrafluoride, titanium trifluoride, titanium tetrafluoride, ferric fluoride, chromium difluoride, chromium trifluoride manganese difluoride, manganese trifluoride, nickel difluoride, stannous difluoride, stannous tetrafluoride, and combinations thereof.

3. The method of claim 1 wherein the catalyst is 0.4 wt % pwd, masticated catalyst.

4. The method of claim 1 wherein said mixing comprises:

mixing catalyst comprising about 0.2 wt % powdered, masticated catalyst to about 1.0 wt % powdered, masticated catalyst.

5. The method of claim 1 wherein the ZDDP has a phosphorous content of 0.01 wt %.

6. The method of claim 1 wherein the ZDDP has a phosphorous content of about 0.01 wt % to about 0.05 wt %.

7. The method of claim 1 wherein the additive mixture is heated to at least 125° C.

8. The method of claim 1 wherein the additive mixture is heated to between about 60° C. and about 125° C.

9. The method of claim 1 wherein the additive mixture is heated for at least 4 hours.

10. The method of claim 1 wherein the additive mixture is heated about 1 hour.

11. A method of manufacturing an engine oil comprising:

mixing ferric fluoride with zinc dialkyldithiophosphate (ZDDP) to form an additive mixture;

heating the additive mixture to produce a pre-reactive mixture; and adding the pre-reacted mixture to a fully formulated engine oil that does not already include ZDDP.

12. The method of claim 11 wherein the additive mixture is heated to between about 60° C. and about 125° C.

13. The method of claim 11 wherein the additive mixture is heated from about one to about 24 hours.

14. The method of claim 11 wherein the ZDDP has a phosphorous content of about 0.01 wt % to about 0.05 wt %.

15. The method of claim 11 wherein the ZDDP has a phosphorous content of 0.01 wt %.

16. The method of claim 11 wherein the ferric fluoride is 0.4 wt % powdered, masticated catalyst.

17. An engine oil prepared by a process comprising:

mixing a catalyst with zinc dialkyldithiophosphate (ZDDP) to form an additive mixture, wherein said catalyst is a metal fluoride:

heating the additive mixture to about 60° C. to produce a pre-reacted additive mixture; and adding the pre-reacted additive mixture to a fully formulated engine oil that does not already include ZDDP.

18. The engine oil of claim 17 wherein said fully formulated engine oil is a GF4 engine oil without ZDDP.

19. The engine oil of claim 17 wherein said metal fluoride is selected from the group consisting of:

aluminum trifluoride, zirconium tetrafluoride, titanium trifluoride, titanium tetrafluoride, ferric fluoride, chromium difluoride, chromium trifluoride, manganese difluoride, manganese trifluoride, nickel difluoride, stannous difluoride, stannous tetrafluoride, and combinations thereof.

20. The method of claim 17 wherein the additive mixture is heated from about one to about 24 hours.

* * * * *